US012527409B2

(12) United States Patent
Sanchez

(10) Patent No.: US 12,527,409 B2
(45) Date of Patent: Jan. 20, 2026

(54) BEDSHEET RETENTION ASSEMBLY

(71) Applicant: Faith Sanchez, Miles, TX (US)

(72) Inventor: Faith Sanchez, Miles, TX (US)

( * ) Notice: Subject to any disclaimer, the term of this patent is extended or adjusted under 35 U.S.C. 154(b) by 246 days.

(21) Appl. No.: 18/513,880

(22) Filed: Nov. 20, 2023

(65) Prior Publication Data

US 2025/0160548 A1 May 22, 2025

(51) Int. Cl.
*A47C 21/02* (2006.01)
*A47G 9/02* (2006.01)

(52) U.S. Cl.
CPC ..... *A47C 21/022* (2013.01); *A47G 9/0246* (2013.01)

(58) Field of Classification Search
CPC ..... A47G 9/02; A47G 9/0238; A47G 9/0246
See application file for complete search history.

(56) References Cited

U.S. PATENT DOCUMENTS 6,161,235 A 12/2000 Smith
6,243,895 B1 * 6/2001 Amin ..... A47C 27/005 5/482
6,854,139 B2 2/2005 Lamy
7,676,863 B2 3/2010 Henning
8,856,984 B1 10/2014 Donham
2009/0178197 A1 * 7/2009 Swihart ..... A47G 9/02 5/502
2012/0124741 A1 5/2012 Okrzesik
2014/0150181 A1 * 6/2014 Tulloch ..... A47C 21/022 5/496
2017/0251839 A1 * 9/2017 McLeod ..... A47G 9/0246
2023/0263321 A1 * 8/2023 Barnes ..... A47G 9/0292 5/497

FOREIGN PATENT DOCUMENTS

WO WO-2008097192 A1 * 8/2008 ..... A47C 21/022
WO WO2008147790 12/2008

* cited by examiner

*Primary Examiner* — Eric J Kurilla

(57) ABSTRACT

A bedsheet retention assembly includes a fitted sheet that is positionable around a mattress. A drawstring is slidably integrated into the fitted sheet thereby facilitating the drawstring to be tightened for securing the fitted sheet around the mattress. A plurality of grommets is each of the grommets is integrated into the fitted sheet and each of the plurality of grommets is aligned with a respective one of four corners of the mattress when the fitted sheet is positioned around the mattress. A harness is positionable around the mattress and a plurality of hooks is attached to the harness. Each of the plurality of hooks is strategically positioned on the harness thereby facilitating each of the plurality of hooks to be extended through a respective one of the plurality of grommets such that the harness secures the fitted sheet to the mattress.

7 Claims, 7 Drawing Sheets

BEDSHEET RETENTION ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to bedsheet devices and more particularly pertains to a new bedsheet device for retaining a fitted sheet on a mattress. The device includes a fitted sheet with a plurality of grommets that can be positioned around a mattress and a harness that is positionable around the mattress. The device includes a plurality of hooks that are each attached to the harness and each of the hooks is extendable through a respective one of the grommets for retaining the fitted sheet on the mattress.

(2) Description of Related Art Including Information Disclosed Under 37 CFR 1.97 and 1.98

The prior art relates to bedsheet devices including a fitted bed sheet and a harness that is attachable to the fitted bed sheet which extends beneath a mattress for retaining the fitted bed sheet on the mattress and a variety of ornamental bed sheets that have fastening elements for suspending pockets or a bed skirt on a mattress. In no instance does the prior art disclose a bed sheet device that includes a fitted bed sheet that has a plurality of grommets and a harness that is positionable around the mattress and a plurality of hooks attached to the harness which extend through respective grommets for securing the fitted bed sheet to the mattress.

(h) BRIEF SUMMARY OF THE INVENTION

An embodiment of the disclosure meets the needs presented above by generally comprising a fitted sheet that is positionable around a mattress. A drawstring is slidably integrated into the fitted sheet thereby facilitating the drawstring to be tightened for securing the fitted sheet around the mattress. A plurality of grommets is each of the grommets is integrated into the fitted sheet and each of the plurality of grommets is aligned with a respective one of four corners of the mattress when the fitted sheet is positioned around the mattress. A harness is positionable around the mattress and a plurality of hooks is attached to the harness. Each of the plurality of hooks is strategically positioned on the harness thereby facilitating each of the plurality of hooks to be extended through a respective one of the plurality of grommets such that the harness secures the fitted sheet to the mattress.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
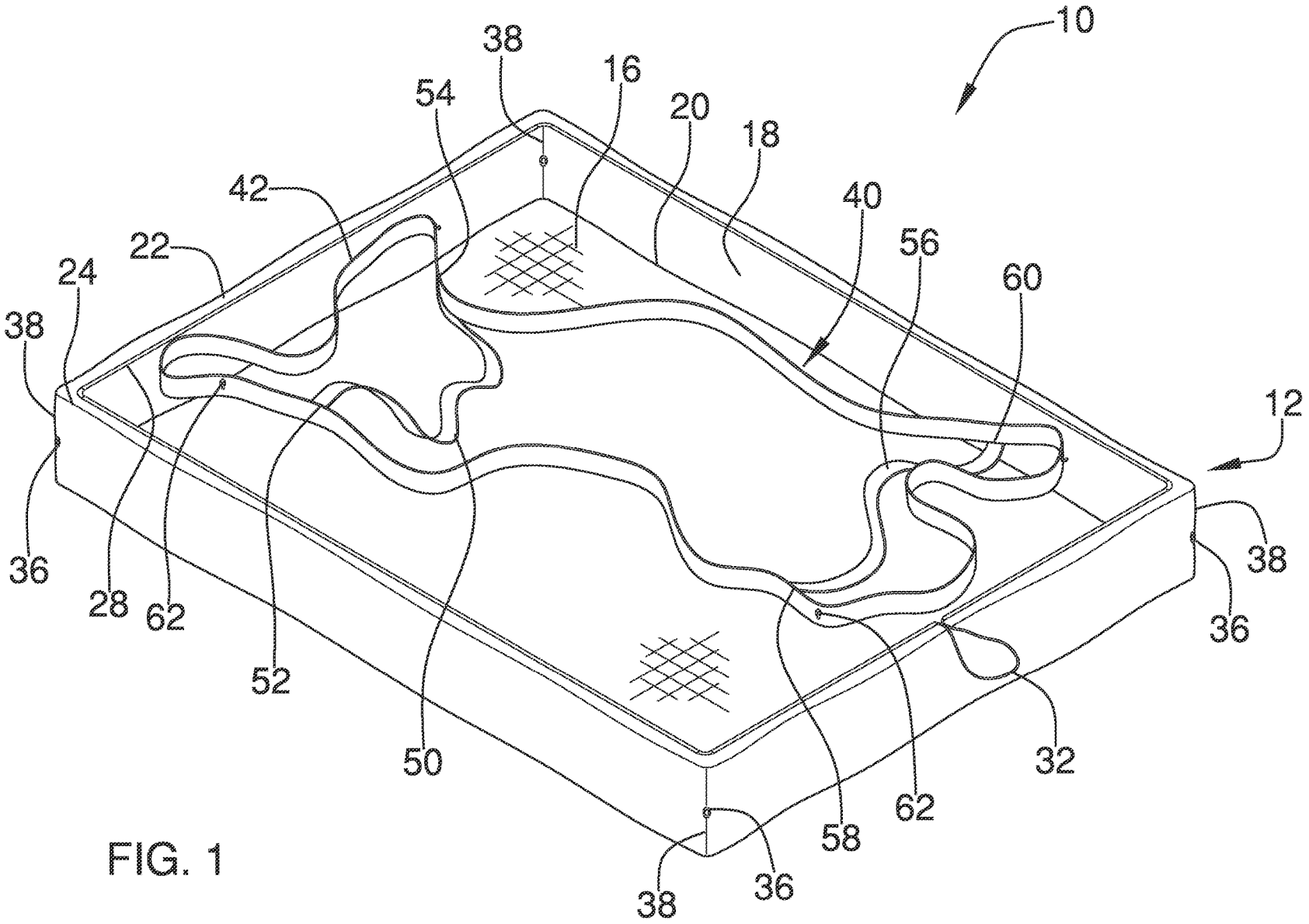
FIG. 1 is a bottom perspective view of a bedsheet retention assembly according to an embodiment of the disclosure.
Figure 2:
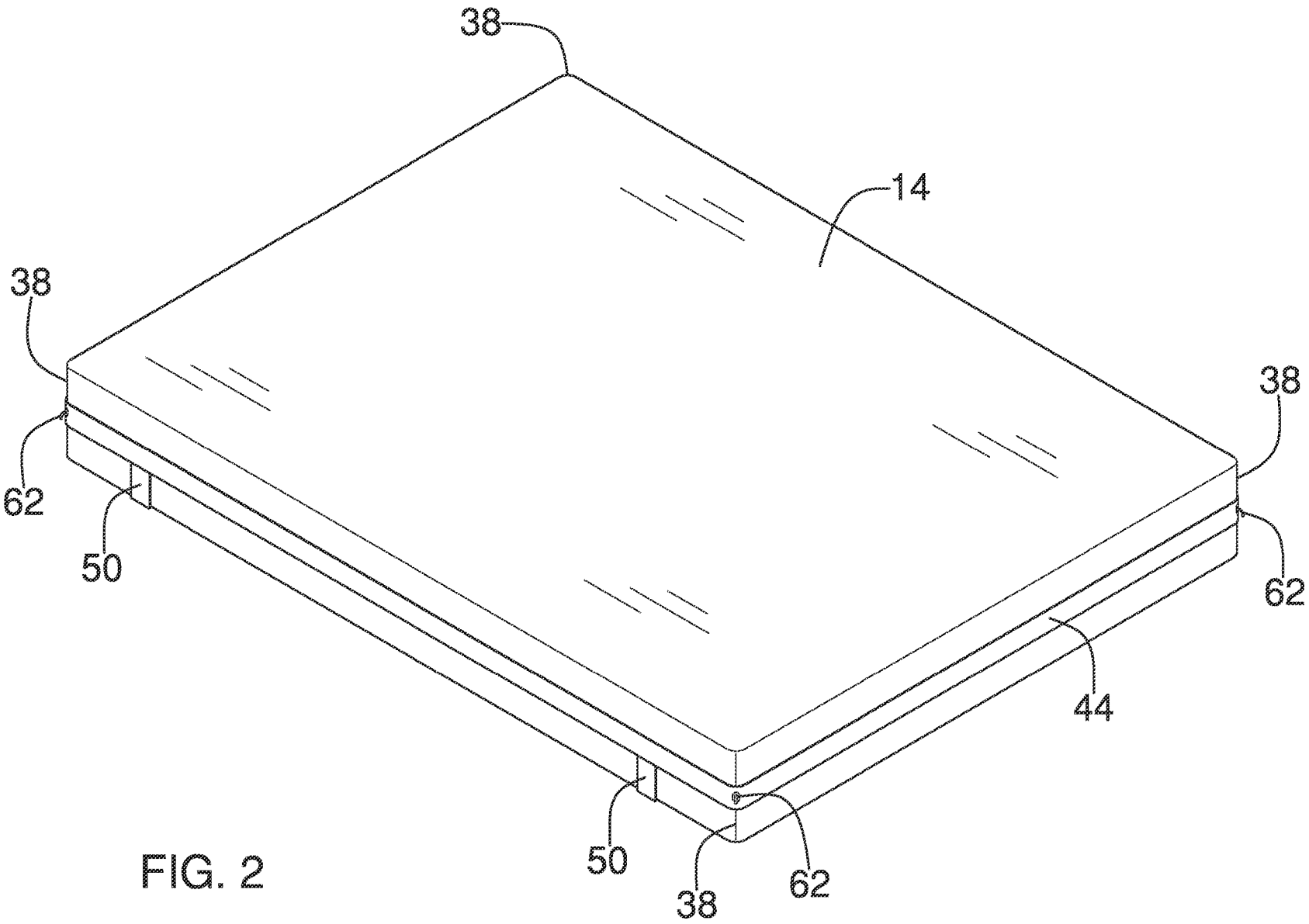
FIG. 2 is a top perspective view of an embodiment of the disclosure showing a harness being positioned around a mattress 6.
Figure 3:
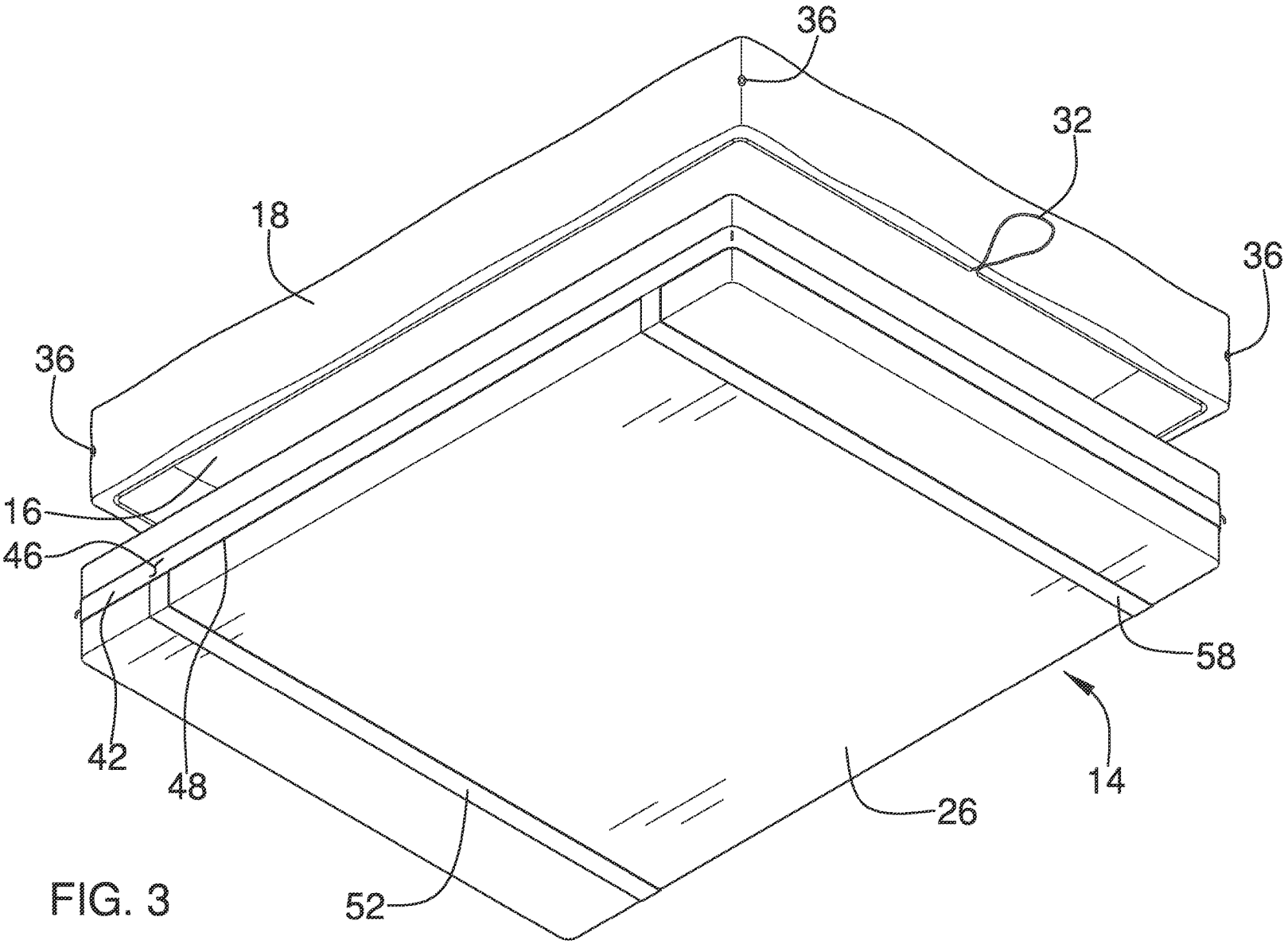
FIG. 3 is a bottom perspective exploded view of an embodiment of the disclosure.
Figure 4:
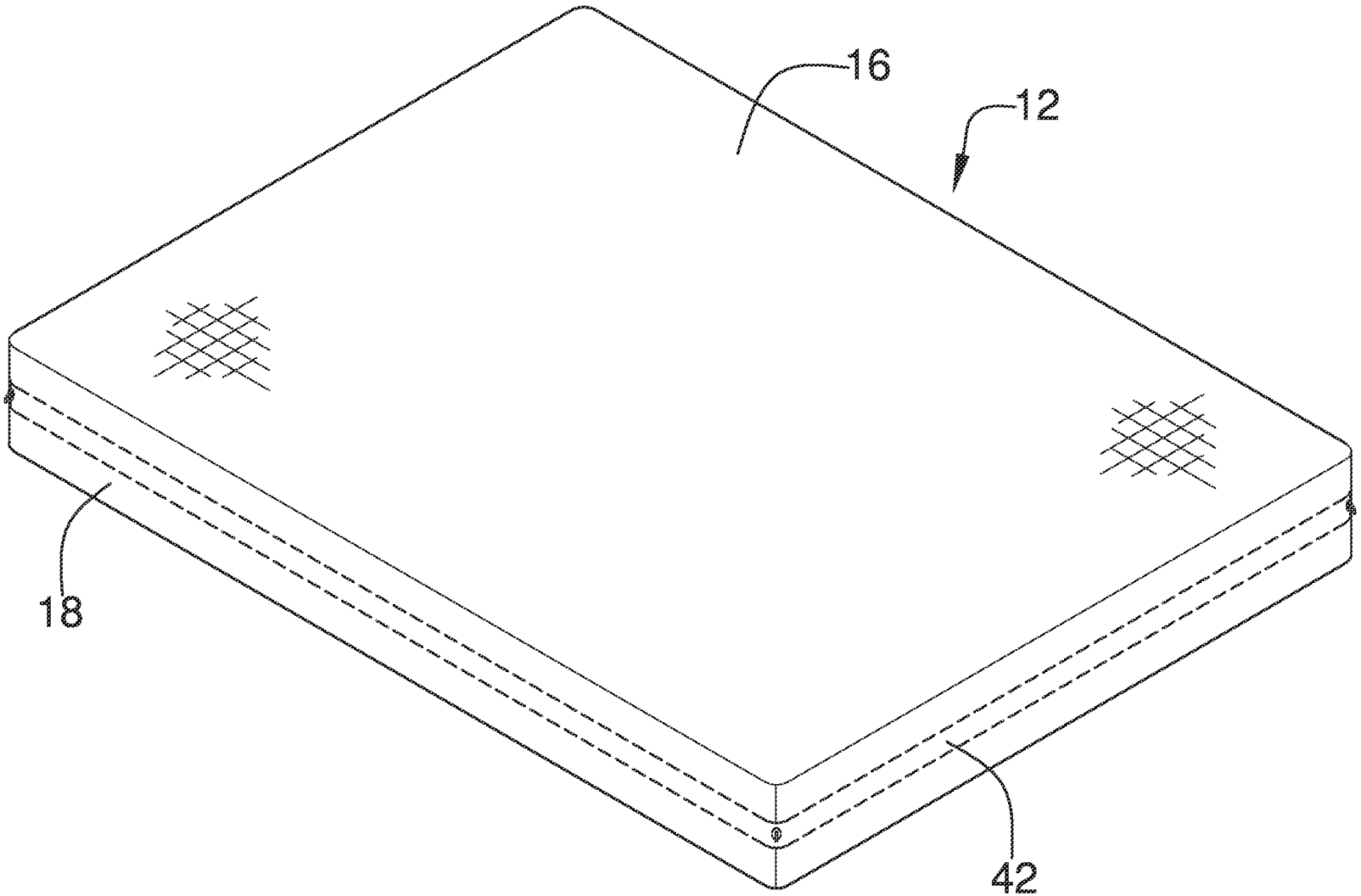
FIG. 4 is a perspective phantom view of an embodiment of the disclosure.
Figure 5:
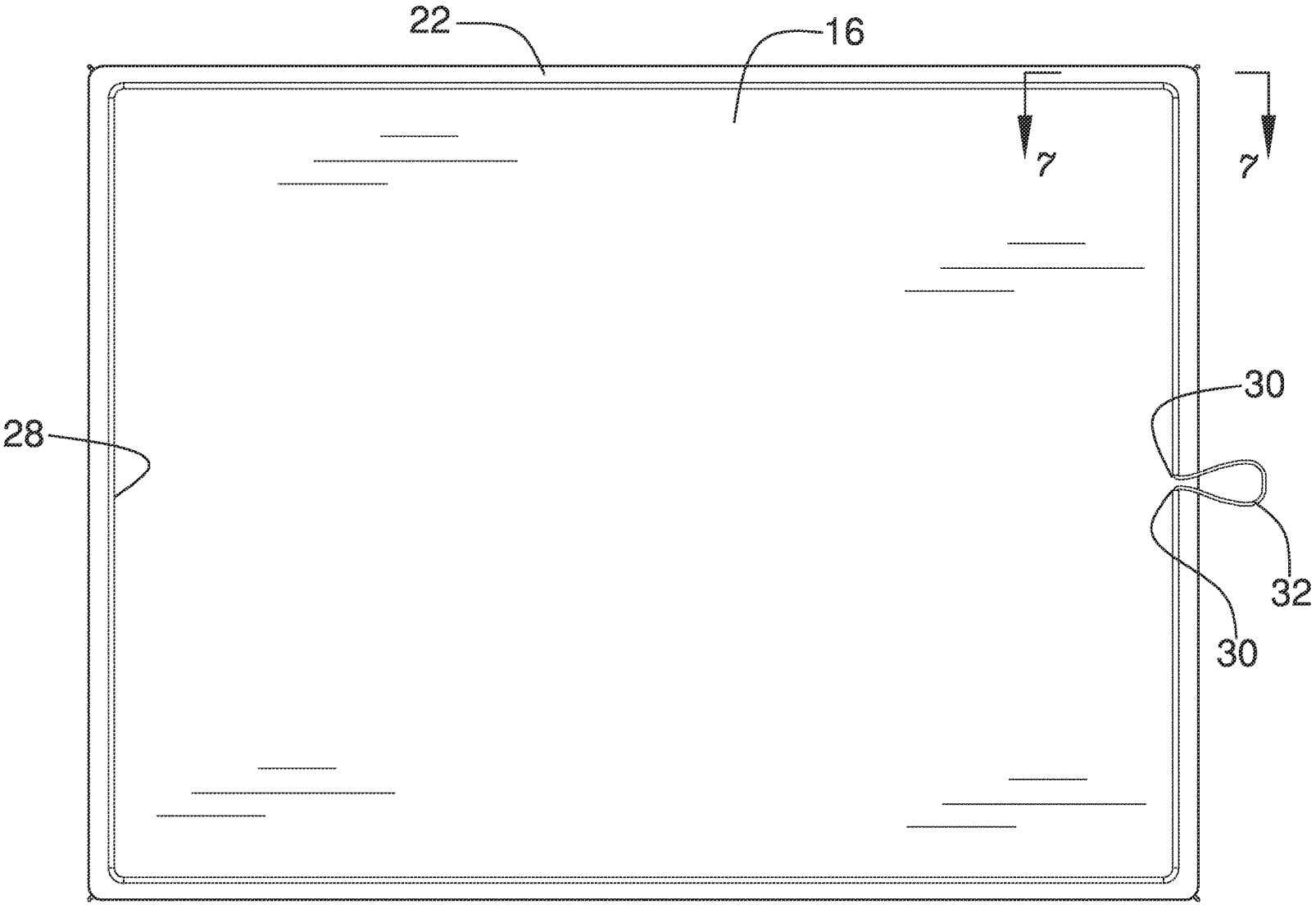
FIG. 5 is a bottom view of an embodiment of the disclosure.
Figure 6:
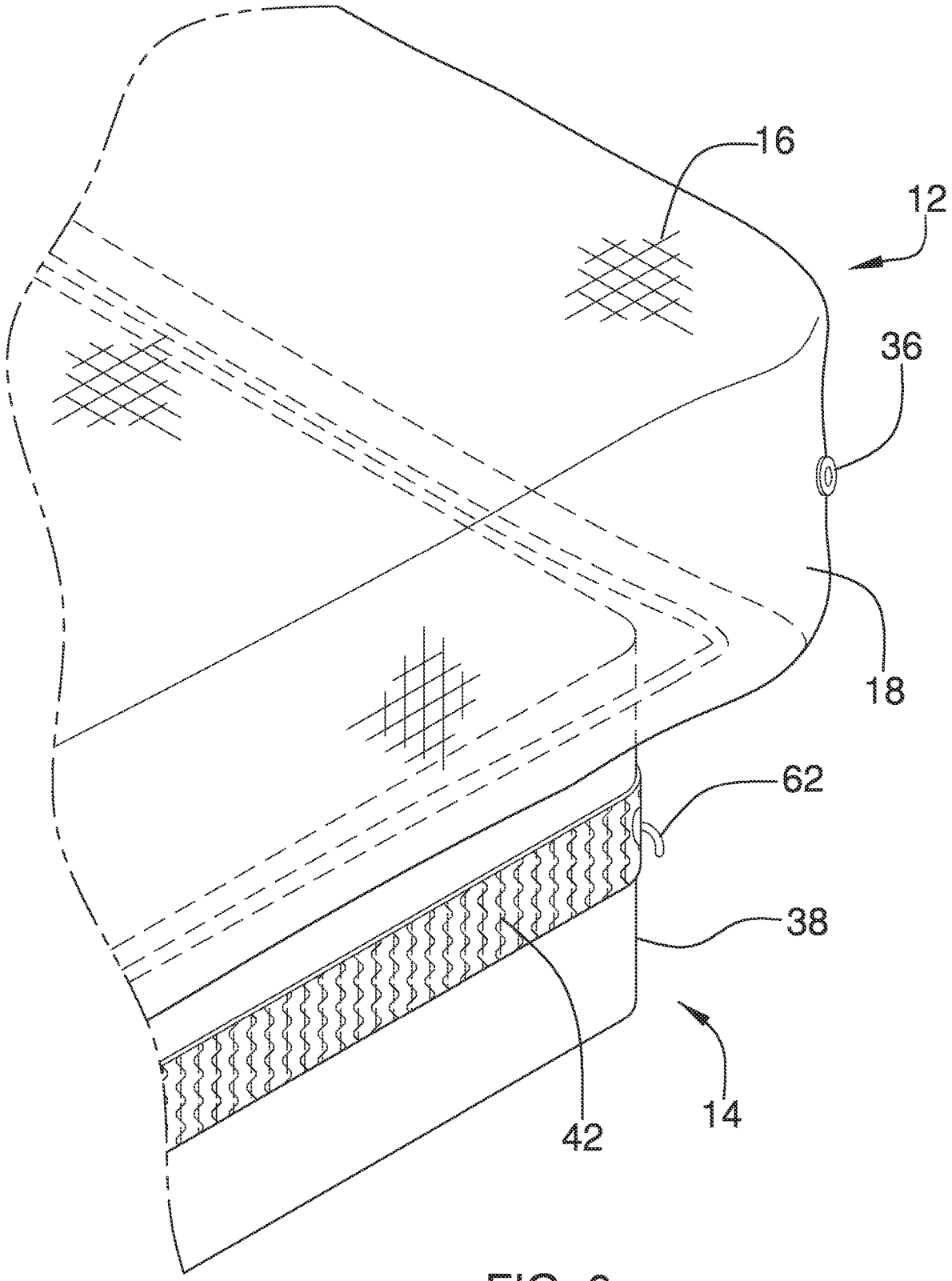
FIG. 6 is an exploded in-use view of an embodiment of the disclosure showing a fitted sheet being fitted over a mattress.
Figure 7:
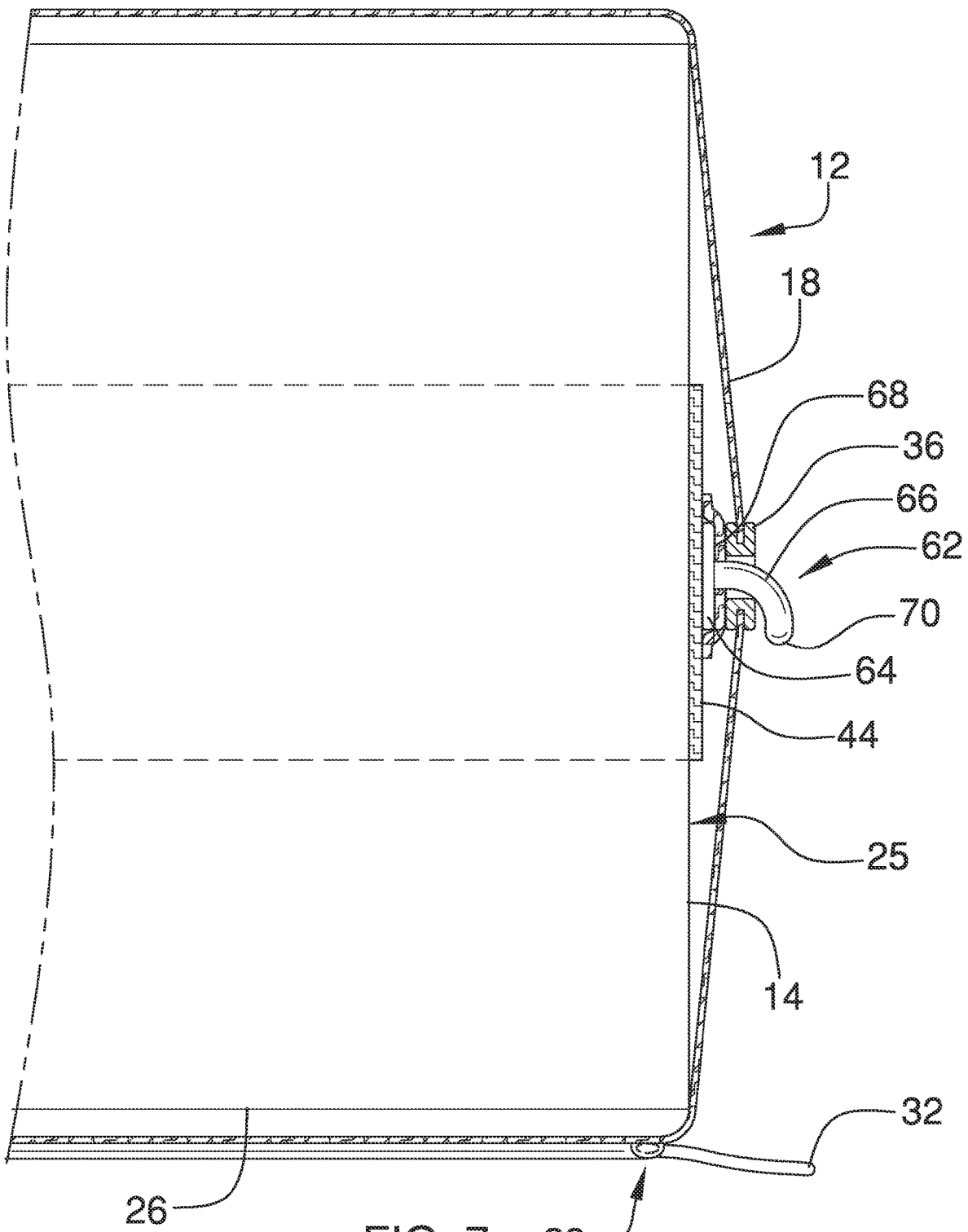
FIG. 7 is a cross sectional view of an embodiment of the disclosure.

With reference now to the drawings, and in particular to FIGS. 1 through 7 thereof, a new bedsheet device embodying the principles and concepts of an embodiment of the disclosure and generally designated by the reference numeral 10 will be described.

As best illustrated in FIGS. 1 through 7, the bedsheet retention assembly 10 generally comprises a fitted sheet 12 that is positionable around a mattress 14. The mattress 14 may be a twin size mattress, a queen sized mattress, a king sized mattress or any other conventional size of mattress commonly employed for sleeping. The fitted sheet 12 may be manufactured in a variety of sizes to fit the size of the mattress 14. The fitted sheet 12 has a top panel 16 and a perimeter panel 18 extending downwardly from an outer edge 20 of the top panel 16 and the fitted sheet 12 has a lip 22 extending inwardly from the perimeter panel 18. The lip 22 is aligned with a lower edge 24 of the perimeter panel 18 having the lip 22 lying on a plane oriented parallel to the top panel 16 and the lip 22 extends around a full perimeter of the perimeter panel 18.

The top panel 16 lies on top of the mattress 14 having the perimeter panel 18 extending downwardly along sides 25 of the mattress 14. The lip 22 rests against a bottom 26 of the mattress 14 when the fitted sheet 12 is positioned around the mattress 14. Additionally, the lip 22 is folded over onto itself to define a channel 28 extending around a substantial perimeter of the lip 22 such that a pair of terminal ends 30 of the channel 28 are spaced apart from each other. Furthermore, the channel 28 is spaced from the perimeter panel 18 of the fitted sheet 12.

A drawstring 32 is slidably integrated into the fitted sheet 12 thereby facilitating the drawstring 32 to be tightened for securing the fitted sheet 12 around the mattress 14. The drawstring 32 is positioned in the channel 28 defined by the lip 22. The drawstring 32 extends outwardly through each of the pair of terminal ends 30 of the channel 28 thereby facilitating the drawstring 32 to be gripped for tightening the drawstring 32. Additionally, the drawstring 32 reduces the size of an opening 34 defined by the lip 22 when the drawstring 32 is tightened.

A plurality of grommets 36 is provided and each of the grommets 36 is integrated into the fitted sheet 12. The plurality of grommets 36 is strategically positioned on the fitted sheet 12 such that each of the plurality of grommets 36 is aligned with a respective one of four corners 38 of the mattress 14 when the fitted sheet 12 is positioned around the mattress 14. Each of the plurality grommets 36 extends through the perimeter panel 18 of the fitted sheet 12 and each of the plurality of grommets 36 is aligned with a respective one of four corners 38 of the perimeter panel 18. Additionally, each of the plurality of grommets 36 is centrally positioned between the top panel 16 and the lip 22.

A harness 40 is provided and the harness 40 is positionable around the mattress 14. The harness 40 is comprised of an elastomeric material thereby facilitating the harness 40 to stretch around the mattress 14. The harness 40 comprises a first member 42 that is continuous such that the first member 42 defines a closed loop. The first member 42 extends around each of the sides 25 of the mattress 14 when the harness 40 is positioned around the mattress 14 and the first member 42 has an outwardly facing surface 46 and a bottom edge 48.

The harness 40 includes a second member 50 that has a first end 52 and a second end 54. Each of the first end 52 and the second end 54 is coupled to the bottom edge 48 of the first member 42 such that the second member 50 defines a closed loop with the first member 42. In this way the second member 50 can extend around the bottom 26 of the mattress 14 when the harness 40 is positioned around the mattress 14. The harness 40 includes a third member 56 that has a first end 58 and a second end 60. Each of the first end 58 and the second end 60 of the third member 56 is coupled to the bottom edge 48 of the first member 42 such that the third member 56 defines a closed loop with the first member 42. In this way the third member 56 can extend around the bottom 26 of the mattress 14 when the harness 40 is positioned around the mattress 14. The third member 56 is spaced from the second member 50 such that each of the third member 56 and the second member 50 are positioned proximate to opposite ends of the mattress 14 when the harness 40 is positioned around the mattress 12.

A plurality of hooks 62 is provided and each of the plurality of hooks 62 is attached to the harness 40. Each of the plurality of hooks 62 is strategically positioned on the harness 40 thereby facilitating each of the plurality of hooks 62 to be extended through a respective one of the plurality of grommets 36. In this way the harness 40 secures the fitted sheet 12 to the mattress 14.

Each of the plurality of hooks 62 includes a disk 64 that is sewn into the first member 42 of the harness 40. Each of the plurality of hooks 62 includes a finger 66 that is coupled to and extends away from a front surface 68 of the disk 64. The finger 66 has a distal end 70 with respect to the disk 64 and the finger 66 is curved between the front surface 68 and the distal end 70. The finger 66 extends outwardly from the first member 42 of the harness 40 such that the disk 64 inhibits the finger 66 from being removed from the first member 42. The finger 66 is extendable through a respective one of the plurality of grommets 36 in the fitted sheet 12 for securing the fitted sheet 12 to the harness 40. Additionally, each of the plurality of hooks 62 is oriented such that the finger 66 associated with the plurality of hooks 62 curves downwardly when the harness 40 is positioned around the mattress 14 thereby inhibiting the respective grommet from sliding off of the finger 66.

In use, the harness 40 is positioned around the mattress 14 such that each of the plurality of hooks 62 is aligned with a respective one of the four corners 38 of the mattress 14. The fitted sheet 12 is positioned around the mattress 14 such that the lip 22 extends beneath the bottom 26 of the mattress 14 and each of the grommets 36 is aligned with a respective one of the four corners 38 of the mattress 14. The drawstring 32 is tightened, if necessary, and each of the hooks 62 is extended through the respective grommet 36. In this way the fitted sheet 12 is retained on the mattress 14 thereby inhibiting the fitted sheet 12 from becoming unfitted from the mattress 14 while the mattress 14 is being employed for sleeping.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bedsheet retention assembly for retaining a fitted sheet on a mattress, said assembly comprising:

a fitted sheet being positionable around a mattress;

a drawstring being slidably integrated into said fitted sheet thereby facilitating said drawstring to be tightened for securing said fitted sheet around said mattress;

a plurality of grommets, each of said grommets being integrated into said fitted sheet, said plurality of grommets being strategically positioned on said fitted sheet such that each of said plurality of grommets is aligned with a respective one of four corners of said mattress when said fitted sheet is positioned around said mattress;

a harness being positionable around said mattress, said harness being comprised of an elastomeric material thereby facilitating said harness to stretch around said mattress; and a plurality of hooks, each of said plurality of hooks being attached to said harness, each of said plurality of hooks being strategically positioned on said harness thereby facilitating each of said plurality of hooks to be extended through a respective one of said plurality of grommets such that said harness secures said fitted sheet to said mattress.

2. The assembly according to claim 1, wherein:

said fitted sheet has a top panel and a perimeter panel extending downwardly from an outer edge of said top panel;

said fitted sheet has a lip extending inwardly from said perimeter panel, said lip being aligned with a lower edge of said perimeter panel having said lip lying on a plane being oriented parallel to said top panel, said lip extending around a full perimeter of said perimeter panel;

said top panel lies on top of said mattress having said perimeter panel extending downwardly along sides of said mattress and having said lip resting against a bottom of said mattress when said fitted sheet is positioned around said mattress; and said lip is folded over onto itself to define a channel extending around a substantial perimeter of said lip such that a pair of terminal ends of said channel are spaced apart from each other, said channel being spaced from said perimeter panel of said fitted sheet.

3. The assembly according to claim 2, wherein said drawstring is positioned in said channel defined by said lip, said drawstring extending outwardly through each of said pair of terminal ends of said channel thereby facilitating said drawstring to be gripped for tightening said drawstring, said drawstring reducing the size of an opening defined by said lip when said drawstring is tightened.

4. The assembly according to claim 2, wherein each of said plurality grommets extends through said perimeter panel of said fitted sheet, each of said plurality of grommets being aligned with a respective one of four corners of said perimeter panel, each of said plurality of grommets being centrally positioned between said top panel and said lip.

5. The assembly according to claim 1, wherein said harness comprises:

a first member being continuous such that said first member defines a closed loop, said first member extending around each of a plurality of sides of said mattress when said harness is positioned around said mattress, said first member having an outwardly facing surface and a bottom edge;

a second member having a first end and a second end, each of said first end and said second end being coupled to said bottom edge of said first member such that said second member defines a closed loop with said first member thereby facilitating said second member to extend around a bottom of said mattress when said harness is positioned around said mattress; and a third member having a first end and a second end, each of said first end and said second end of said third member being coupled to said bottom edge of said first member such that said third member defines a closed loop with said first member thereby facilitating said third member to extend around said bottom of said mattress when said harness is positioned around said mattress.

6. The assembly according to claim 5, wherein each of said plurality of hooks includes:

a disk being sewn into said first member of said harness; and a finger being coupled to and extending away from a front surface of said disk, said finger having a distal end with respect to said disk, said finger being curved between said front surface and said distal end, said finger extending outwardly from said outwardly facing surface of said first member of said harness such that said disk inhibits said finger from being removed from said first member, said finger being extendable through a respective one of said plurality of grommets in said fitted sheet for securing said fitted sheet to said harness, each of said plurality of hooks being oriented such that said finger associated with said plurality of hooks curves downwardly when said harness is positioned around said mattress thereby inhibiting said respective grommet from sliding off of said finger.

7. A bedsheet retention assembly for retaining a fitted sheet on a mattress, said assembly comprising:

a fitted sheet being positionable around a mattress, said fitted sheet having a top panel and a perimeter panel extending downwardly from an outer edge of said top panel, said fitted sheet having a lip extending inwardly from said perimeter panel, said lip being aligned with a lower edge of said perimeter panel having said lip lying on a plane being oriented parallel to said top panel, said lip extending around a full perimeter of said perimeter panel, said top panel lying on top of said mattress having said perimeter panel extending downwardly along sides of said mattress and having said lip resting against a bottom of said mattress when said fitted sheet is positioned around said mattress, said lip being folded over onto itself to define a channel extending around a substantial perimeter of said lip such that a pair of terminal ends of said channel are spaced apart from each other, said channel being spaced from said perimeter panel of said fitted sheet;

a drawstring being slidably integrated into said fitted sheet thereby facilitating said drawstring to be tightened for securing said fitted sheet around said mattress, said drawstring being positioned in said channel defined by said lip, said drawstring extending outwardly through each of said pair of terminal ends of said channel thereby facilitating said drawstring to be gripped for tightening said drawstring, said drawstring reducing the size of an opening defined by said lip when said drawstring is tightened;

a plurality of grommets, each of said grommets being integrated into said fitted sheet, said plurality of grommets being strategically positioned on said fitted sheet such that each of said plurality of grommets is aligned with a respective one of four corners of said mattress when said fitted sheet is positioned around said mattress, each of said plurality grommets extending through said perimeter panel of said fitted sheet, each of said plurality of grommets being aligned with a respective one of four corners of said perimeter panel, each of said plurality of grommets being centrally positioned between said top panel and said lip;

a harness being positionable around said mattress, said harness being comprised of an elastomeric material thereby facilitating said harness to stretch around said mattress, said harness comprising:

a first member being continuous such that said first member defines a closed loop, said first member extending around each of said sides of said mattress when said harness is positioned around said mattress, said first member having an outwardly facing surface and a bottom edge;

a second member having a first end and a second end, each of said first end and said second end being coupled to said bottom edge of said first member such that said second member defines a closed loop with said first member thereby facilitating said second member to extend around said bottom of said mattress when said harness is positioned around said mattress; and a third member having a first end and a second end, each of said first end and said second end of said third member being coupled to said bottom edge of said first member such that said third member defines a closed loop with said first member thereby facilitating said third member to extend around said bottom of said mattress when said harness is positioned around said mattress; and a plurality of hooks, each of said plurality of hooks being attached to said harness, each of said plurality of hooks being strategically positioned on said harness thereby facilitating each of said plurality of hooks to be extended through a respective one of said plurality of grommets such that said harness secures said fitted sheet to said mattress, each of said plurality of hooks including:

a disk being sewn into said first member of said harness; and a finger being coupled to and extending away from a front surface of said disk, said finger having a distal end with respect to said disk, said finger being curved between said front surface and said distal end, said finger extending outwardly from said outwardly facing surface of said first member of said harness such that said disk inhibits said finger from being removed from said first member, said finger being extendable through a respective one of said plurality of grommets in said fitted sheet for securing said fitted sheet to said harness, each of said plurality of hooks being oriented such that said finger associated with said plurality of hooks curves downwardly when said harness is positioned around said mattress thereby inhibiting said respective grommet from sliding off of said finger.

* * * * *